US008997900B2

(12) United States Patent
Sue et al.

(10) Patent No.: US 8,997,900 B2
(45) Date of Patent: Apr. 7, 2015

(54) IN-SITU BORON DOPED PDC ELEMENT

(75) Inventors: Jiinjen Albert Sue, The Woodlands, TX (US); Harold Sreshta, Conroe, TX (US)

(73) Assignee: National Oilwell DHT, L.P., Houston, TX (US)

( * ) Notice: Subject to any disclaimer, the term of this patent is extended or adjusted under 35 U.S.C. 154(b) by 320 days.

(21) Appl. No.: 12/968,590

(22) Filed: Dec. 15, 2010

(65) Prior Publication Data

US 2012/0152622 A1 Jun. 21, 2012

(51) Int. Cl.
*E21B 10/36* (2006.01)
*E21B 10/567* (2006.01)
*E21B 10/573* (2006.01)

(52) U.S. Cl.
CPC ..... *E21B 10/567* (2013.01); *E21B 10/573* (2013.01)

(58) Field of Classification Search
None
See application file for complete search history.

(56) References Cited

U.S. PATENT DOCUMENTS

| | | | |
|---|---|---|---|
| 2,992,900 | A | 7/1961 | Bovenkerk |
| 3,141,746 | A | 7/1964 | Lai |
| 3,141,855 | A | 7/1964 | Wentorf, Jr. |
| 3,148,161 | A | 9/1964 | Wentorf, Jr. et al. |
| 3,574,580 | A | 4/1971 | Stromberg et al. |
| 3,744,982 | A | 7/1973 | Bovenkerk et al. |
| 3,745,623 | A | 7/1973 | Wentorf, Jr. et al. |
| 3,800,891 | A | 4/1974 | White et al. |
| 3,831,428 | A | 8/1974 | Wentorf, Jr. et al. |
| 3,913,280 | A | 10/1975 | Hall |
| 4,024,675 | A | 5/1977 | Naidich et al. |
| 4,219,339 | A | 8/1980 | Wilson |
| 4,224,380 | A | 9/1980 | Bovenkerk et al. |
| 4,255,165 | A | 3/1981 | Dennis et al. |
| 4,268,276 | A | 5/1981 | Bovenkerk |
| 4,288,248 | A | 9/1981 | Bovenkerk et al. |
| 4,368,788 | A | 1/1983 | Drake |
| 4,372,404 | A | 2/1983 | Drake |
| 4,398,952 | A | 8/1983 | Drake |
| 4,481,180 | A | 11/1984 | Bedere et al. |
| 4,525,179 | A | 6/1985 | Gigl |
| 4,534,773 | A | 8/1985 | Phaal et al. |
| 4,554,130 | A | 11/1985 | Ecer |
| 4,562,892 | A | 1/1986 | Ecer |
| 4,592,252 | A | 6/1986 | Ecer |
| 4,593,777 | A | 6/1986 | Barr |

(Continued)

FOREIGN PATENT DOCUMENTS

| | | |
|---|---|---|
| CA | 2423099 | 3/2002 |
| EP | 0180243 | 5/1986 |

(Continued)

OTHER PUBLICATIONS

"What's SPS?" Description online. Fuji Electronic Industrial Co., Ltd. Retrieved from Internet on Dec. 13, 2011: <URL: http://sps.fdc.co.jp/whats/> 8 pages.

(Continued)

*Primary Examiner* — Jennifer H Gay
*Assistant Examiner* — Caroline Butcher
(74) *Attorney, Agent, or Firm* — JL Salazar Law Firm

(57) ABSTRACT

A polycrystalline diamond compact formed in an in-situ boron-doped process. The in-situ boron-doped process includes consolidating a mixture of diamond crystals and boron-containing alloy via liquid diffusion of boron into diamond crystals at a pressure greater than 5 Gpa and at a temperature greater than the melting temperature of the boron-containing alloy, typically less than about 1450° C.

21 Claims, 3 Drawing Sheets

(56) References Cited

U.S. PATENT DOCUMENTS

| | | | |
|---|---|---|---|
| 4,604,106 | A | 8/1986 | Hall |
| 4,629,373 | A | 12/1986 | Hall |
| 4,630,692 | A | 12/1986 | Ecer |
| 4,726,432 | A | 2/1988 | Scott et al. |
| 4,770,907 | A | 9/1988 | Kimura |
| 4,995,887 | A | 2/1991 | Barr et al. |
| 5,011,509 | A | 4/1991 | Frushour |
| 5,011,514 | A | 4/1991 | Cho et al. |
| 5,024,680 | A | 6/1991 | Chen et al. |
| 5,106,391 | A | 4/1992 | Lloyd |
| 5,127,923 | A | 7/1992 | Bunting et al. |
| 5,172,778 | A | 12/1992 | Tibbitts et al. |
| 5,301,762 | A | 4/1994 | Besson |
| 5,304,342 | A | 4/1994 | Hall, Jr. et al. |
| 5,351,772 | A | 10/1994 | Smith |
| 5,433,280 | A | 7/1995 | Smith |
| 5,437,343 | A | 8/1995 | Cooley et al. |
| 5,469,927 | A | 11/1995 | Griffin |
| 5,510,193 | A | 4/1996 | Cerutti et al. |
| 5,544,550 | A | 8/1996 | Smith |
| 5,611,251 | A | 3/1997 | Katayama |
| 5,645,617 | A | 7/1997 | Frushour |
| 5,653,299 | A | 8/1997 | Sreshta et al. |
| 5,697,994 | A | 12/1997 | Packer et al. |
| 5,755,298 | A | 5/1998 | Langford, Jr. et al. |
| 5,776,615 | A | 7/1998 | Wong et al. |
| 5,816,090 | A | 10/1998 | Hodge et al. |
| 5,839,329 | A | 11/1998 | Smith et al. |
| 5,876,793 | A | 3/1999 | Sherman et al. |
| 5,880,382 | A | 3/1999 | Fang et al. |
| 5,957,006 | A | 9/1999 | Smith |
| 5,967,248 | A | 10/1999 | Drake et al. |
| 5,981,057 | A | 11/1999 | Collins |
| 5,988,302 | A | 11/1999 | Sreshta et al. |
| 6,003,623 | A | 12/1999 | Miess |
| 6,041,875 | A | 3/2000 | Rai et al. |
| 6,045,440 | A | 4/2000 | Johnson et al. |
| 6,045,750 | A | 4/2000 | Drake et al. |
| 6,063,333 | A | 5/2000 | Dennis |
| 6,065,554 | A | 5/2000 | Taylor et al. |
| 6,068,913 | A | 5/2000 | Cho et al. |
| 6,158,304 | A | 12/2000 | Packer et al. |
| 6,193,001 | B1 | 2/2001 | Eyre et al. |
| 6,196,910 | B1 | 3/2001 | Johnson et al. |
| 6,200,514 | B1 | 3/2001 | Meister |
| 6,202,770 | B1 | 3/2001 | Jurewicz et al. |
| 6,209,420 | B1 | 4/2001 | Butcher et al. |
| 6,238,280 | B1 | 5/2001 | Ritt et al. |
| 6,322,891 | B1 | 11/2001 | Meng et al. |
| 6,353,771 | B1 | 3/2002 | Southland |
| 6,454,030 | B1 | 9/2002 | Findley et al. |
| 6,544,308 | B2 | 4/2003 | Griffin et al. |
| 6,592,985 | B2 | 7/2003 | Griffin et al. |
| 6,601,662 | B2 | 8/2003 | Matthias et al. |
| 6,612,383 | B2 | 9/2003 | Desai et al. |
| 6,655,481 | B2 | 12/2003 | Findley et al. |
| 6,830,598 | B1 | 12/2004 | Sung |
| 6,852,414 | B1 | 2/2005 | Frushour |
| 6,861,098 | B2 | 3/2005 | Griffin et al. |
| 6,962,751 | B2 | 11/2005 | Fukui et al. |
| 7,160,617 | B2 | 1/2007 | Scarsbrook et al. |
| 7,201,886 | B2 | 4/2007 | Linares et al. |
| 7,384,436 | B2 | 6/2008 | Sung |
| 7,407,012 | B2 | 8/2008 | Keshavan et al. |
| 7,435,478 | B2 | 10/2008 | Keshavan |
| 7,475,743 | B2 | 1/2009 | Liang et al. |
| 7,493,973 | B2 | 2/2009 | Keshavan et al. |
| 7,533,740 | B2 | 5/2009 | Zhang et al. |
| 7,588,102 | B2 | 9/2009 | Hall et al. |
| 7,753,143 | B1 | 7/2010 | Miess et al. |
| 7,862,634 | B2 | 1/2011 | Belnap |
| 7,862,932 | B2 | 1/2011 | Eguchi |
| 7,963,348 | B2 | 6/2011 | Laird |
| 7,972,409 | B2 | 7/2011 | Fujino |
| 8,080,071 | B1 * | 12/2011 | Vail ..... 51/293 |
| 8,277,722 | B2 | 10/2012 | DiGiovanni |
| 2005/0044800 | A1 | 3/2005 | Hall et al. |
| 2005/0109545 | A1 | 5/2005 | Lockwood et al. |
| 2005/0115744 | A1 | 6/2005 | Griffin et al. |
| 2005/0146086 | A1 | 7/2005 | Pope et al. |
| 2005/0210755 | A1 | 9/2005 | Cho et al. |
| 2006/0060391 | A1 | 3/2006 | Eyre et al. |
| 2006/0060392 | A1 | 3/2006 | Eyre |
| 2006/0165993 | A1 | 7/2006 | Keshavan |
| 2006/0191723 | A1 | 8/2006 | Keshavan |
| 2006/0207802 | A1 | 9/2006 | Zhang et al. |
| 2006/0266559 | A1 | 11/2006 | Keshavan et al. |
| 2007/0039762 | A1 | 2/2007 | Achilles |
| 2007/0277651 | A1 | 12/2007 | Calnan et al. |
| 2008/0028891 | A1 | 2/2008 | Calnan et al. |
| 2008/0142275 | A1 | 6/2008 | Griffin et al. |
| 2008/0149397 | A1 | 6/2008 | Overstreet |
| 2009/0107291 | A1 | 4/2009 | Levashov et al. |
| 2009/0166094 | A1 | 7/2009 | Keshavan et al. |
| 2009/0173015 | A1 | 7/2009 | Keshavan et al. |
| 2009/0313908 | A1 * | 12/2009 | Zhang et al. ..... 51/309 |
| 2010/0294571 | A1 | 11/2010 | Belnap |
| 2010/0314176 | A1 * | 12/2010 | Zhang et al. ..... 175/383 |
| 2010/0320005 | A1 | 12/2010 | Burhan |
| 2011/0212303 | A1 | 9/2011 | Fuller et al. |

FOREIGN PATENT DOCUMENTS

| | | |
|---|---|---|
| EP | 1190791 | 3/2002 |
| GB | 2433525 | 6/2007 |
| GB | 2451951 | 2/2009 |
| GB | 2453435 | 4/2009 |
| GB | 2455425 | 6/2009 |
| GB | 2467570 | 8/2010 |
| UA | 74010 | 7/2003 |
| WO | 0224601 | 3/2002 |
| WO | 0224603 | 3/2002 |

OTHER PUBLICATIONS

International Search Report and Written Opinion from counterpart PCT Application No. PCT/US2011/061268 dated May 3, 2012, 10 pages.

* cited by examiner

IN-SITU BORON DOPED PDC ELEMENT

BACKGROUND OF THE INVENTION

1. Field of the Invention

This disclosure relates to Polycrystalline Diamond Compacts (PDC's) and Polycrystalline Diamond inserts, and in particular, relates to a method of forming such boron-doped PDC's at greatly reduced temperatures.

2. Description of the Related Art

High toughness is a desired property in a single crystal diamond and in polycrystalline diamond compacts (PDC's) for micromachining and rock drilling. Efforts have been made to improve chemical vapor deposition (CVD) single crystal diamond by boron doping its surface. The doping is via the vapor phase of boron in a reactor at temperatures in the 700-1100° C. range as disclosed in U.S. Pat. Nos. 5,981,057, 7,160,617, and 7,201,886. U.S. Pat. No. 5,981,057 was directed to a CVD diamond layer containing at least 0.05% of boron for abrasive resistant tools. U.S. Pat. No. 7,160,617 related to a layer of single crystal boron-doped diamond having a uniform concentration of boron. U.S. Pat. No. 7,201,886 relates to a diamond tool comprising a shaped diamond and at least one layer of single crystal diamond doped with boron and/or isotopes of carbon to improve properties, including color, strength, electrical conductivity, and velocity of sound.

In contrast to CVD vapor doping process, boron-doped diamond crystals were manufactured by high pressure and high temperature (HP/HT) process in 1960's by a method of solid-state diffusion of boron atom into diamond using boron or boron compounds of $B_4C$, $B_2O_3$, BN, $NaB_4O_3$, $B_{10}H_{14}$, NiB and $LiBH_4$, as an activator at a pressure greater than 8.5 Gpa and a temperature greater 1300° C., disclosed in U.S. Pat. No. 3,141,855. Using a powder mixture of carbonaceous materials and boron or compounds containing boron such as $B_4C$, $B_2O_3$, BN, B, $NaB_4O_7$, $B_{10}H_{14}$, NiB, $LiBH_4$ and BP at a pressure great than 5 Gpa and a temperature greater than 1300° C., electrically conductive boron-doped diamond crystals were produced, disclosed in U.S. Pat. No. 3,148,161. However, high toughness of HP/HT doped diamond had not been reported at that time. Producing high quality doped-diamond crystals in the HP/HT process has proven to be expensive and difficult. U.S. Pat. No. 6,322,891 discloses heating a mixture of diamond, a source of boron and inert particles of alumina, magnesium oxide, or silicon oxide, at 800 to 1200° C. to facilitate solid-state diffusion of boron into the surface of diamond crystals and to form boron-doped diamond to improve oxidation and mechanical properties. Bovenkerk disclosed in U.S. Pat. No. 4,268,276 using HP/HT boron-doped diamond crystals to improve diamond-to-diamond self bond characteristics in 1981. No work has been directed to improve mechanical and wear properties of HP/HT polycrystalline boron-doped diamond compact.

More importantly, the solubility of born in diamond was observed to be as high as 7.9 wt %, that is ($[B]=1.4\times10^{22}$, where [B] is expressed in atoms/$cm^3$) in the chemical vapor deposition process. In the past HP/HT processes, only a fraction of boron, about 300 ppm ($[B]=3.3\times10^{19}$) was incorporated into diamond crystals to form boron-doped diamond crystals. The present invention overcomes this limitation by using low-melting-temperature boron-containing Ni-alloys.

BRIEF SUMMARY OF THE INVENTION

In-situ boron-doped polycrystalline diamond compacts (PDC's) are produced by consolidating a mixture of diamond crystals and boron-containing alloy via liquid diffusion of boron into diamond crystals at a pressure greater than 5 Gpa and at a temperature greater than the melting temperature of a boron-containing alloy. Synthetic diamond and boron-doped diamond crystals, manufactured by chemical vapor deposition and HP/HT processes, and natural diamonds may be used as a source material. The boron containing alloy can be Ni-, Co-, and Fe-base alloys with their melting temperature below the conventional stable temperature 1450° C. that converts diamond from graphite at a pressure of greater than 5.5 Gpa. The typical melting temperature of boron containing alloy is about 960° C. to 1200° C. In addition, the in-situ boron doped PDC cutter can be manufactured at relatively very low temperatures, as low as 1100° C. This melting temperature is far less that the typical processing temperatures which may be as high as 2000° C.

DETAILED DESCRIPTION OF THE INVENTION

In the following description, it is understood that the sintered composite described hereafter is typically formed of polycrystalline diamond (or PCD), as the material is often referred to in the art. However, this process may also be applicable to any of the other super hard abrasive materials, including, but not limited to, synthetic or natural diamond, cubic boron nitride, and related materials.

Polycrystalline diamond compacts (also known as PDC's), may be used for, but not limited to, drilling tools for exploration and production of hydrocarbon minerals from the earth. More specifically they may be used for cutting elements in earth boring drill bits, as shown in FIGS. 1-3.

Figure 1:
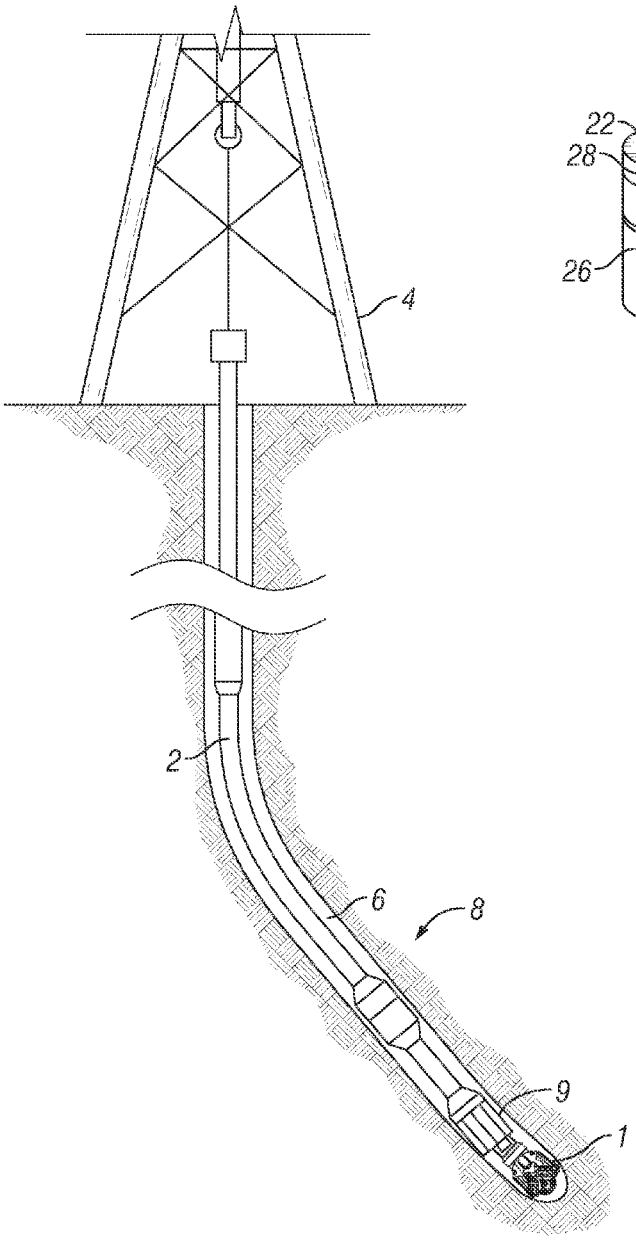
FIG. 1 is a representation of a drilling operation showing a drill string suspended by a derrick for drilling a borehole into the earth.
Figure 2:
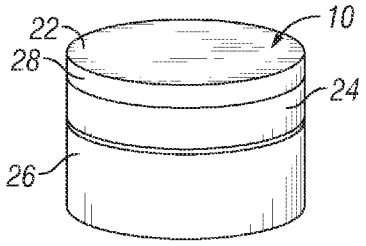
FIG. 2 is a perspective view of a PDC cutting element of the present invention.

A typical drilling operation is shown, for illustrative purposes only, in FIG. 1. This figure shows a representation of a drill string 2 suspended by a derrick 4 for drilling a borehole 6 into the earth. These boreholes 6 may be drilled for minerals exploration and recovery, and in particular petroleum. A bottom-hole assembly (BHA) 8 is typically located in the drill string 2 at the bottom of the borehole 6. Oftentimes, the BHA 8 may have a downhole drilling motor 9 to rotate a drill bit 1.

As the drill bit 1 is rotated from the surface or by the downhole motor 9, it drills into the earth allowing the drill string 2 to advance, forming the borehole 6. For the purpose of understanding how these systems may be operated, for the type of drilling system illustrated in FIG. 1, the drill bit 1 may be any one of numerous types well known to those skilled in the oil and gas exploration business. This is just one of many types and configurations of bottom hole assemblies 8, however, and is shown only for illustration. There are numerous arrangements and equipment configurations possible for use for drilling boreholes into the earth, and the present disclosure is not limited to the particular configurations as described herein.

Figure 3:
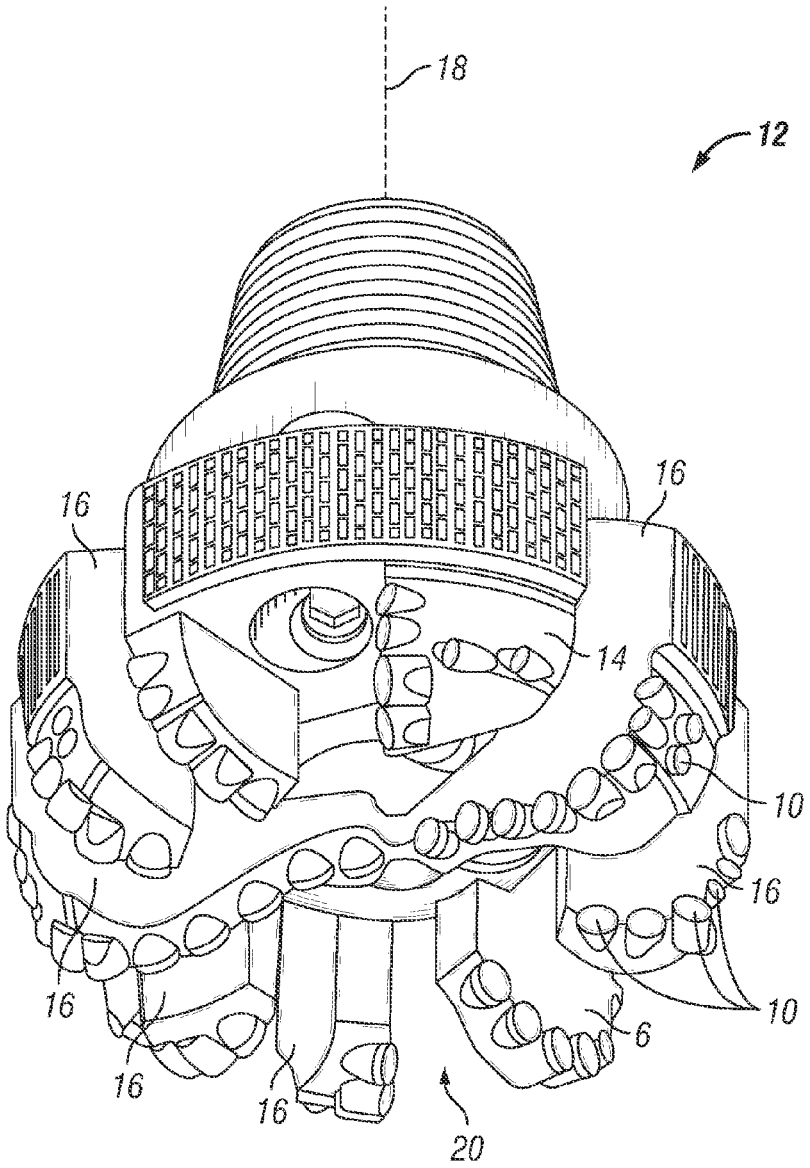
FIG. 3 is a perspective view of a fixed cutter earth-boring drill bit of the present invention.

A more detailed view of the drill bit 1 with a polycrystalline diamond cutting element 10 of the present invention is shown in FIG. 3. Referring now to FIGS. 2 and 3, a polycrystalline diamond cutting element 10 of the present invention may be a preform cutting element 10 (as shown in FIG. 2) for a fixed cutter rotary drill bit 12. The bit body 14 of the drill bit may be formed with a plurality of blades 16 extending generally outwardly away from the central longitudinal axis of rotation 18 of the drill bit. Spaced apart side-by-side along the leading face 20 of each blade 16 is a plurality of the PDC cutting elements 10 of the present invention.

A PDC cutting element 10 of the present invention may have a body in the form of a circular tablet and may have a thin front facing table 22 of polycrystalline diamond integrally formed to a substrate 24 in a high-pressure high-temperature press. The substrate 24 may be materials such as cemented tungsten carbide or other metallic material. The cutting element 10 may be preformed and then may be bonded on a generally cylindrical carrier 26 which may also be formed from cemented tungsten carbide, or may alternatively be attached directly to the blade 16. The preformed cutting element may have a non-planar interface (NPI) between the diamond table 22 and the substrate 24. The PDC cutting element 10 may typically have a peripheral 28 working surface and an end working surface 30 which, as illustrated, are typically substantially perpendicular to one another.

The cylindrical carrier 26 may be received within a correspondingly shaped socket or recess in the blade 16. The carrier 26 may be brazed, shrink fit or press fit into the socket (not shown) in a drill bit 12. When brazed, the braze joint may extend over the carrier 26 and part of the substrate 24. In operation the fixed cutter drill bit 12 is rotated and weight is applied. This forces the cutting elements 10 into the earth being drilled, effecting a cutting and/or drilling action.

Prior to the present invention, these cutting elements 10 were typically made in a very high temperature and high pressure pressing (HTHP) operation (which is well known in the industry) and then finished machined into the cylindrical shapes shown. The typical process used for making these PDC cutting elements 10 typically involved combining mixtures of various sized diamond crystals, which are mixed together, and processed into the PDC elements 10 as previously described.

However, in the present invention, these cutting elements are produced by an in-situ boron-doped process by consolidating a mixture of diamond crystals and boron-containing alloy via liquid diffusion of boron into diamond crystals at a pressure greater than 5 Gpa and at a temperature greater than the melting temperature of a boron-containing alloy. Synthetic diamond and boron-doped diamond crystals, manufactured by chemical vapor deposition and HP/HT processes, and natural diamonds can be used as a source material. Boron-containing alloy can be Ni-, Co-, and Fe-base alloys with their melting temperature well below the conventional stable temperature 1450° C. that converts diamond from graphite at a pressure of greater than 5.5 Gpa. The typical melting temperature of boron containing alloy is about 960° C. to 1200° C.; the in-situ boron doped PDC cutter with diamond-to-diamond bonds can be manufactured at the temperature as low as 1100° C. Table 1 lists commercial boron-containing alloys and silicon-containing alloys and their melting temperatures.

The low melting temperature characteristics of these alloys are critical to in-situ boron doping process. Although alloys 6, 13 and 14 contain no boron, the additional fine boron powder can be introduced in the diamond/Ni alloy powder mixtures. Fine boron powder (micron or submicron size) will dissolve in these alloys while Ni-alloy is in liquid state and commence liquid diffusion into diamond crystals. In the use of chemical vapor deposition and HP/HT boron-doped diamonds in the in-situ boron doping process, boron diffusion occurred through a metal liquid resulted in high level of boron doping. The amount of boron in the in-situ boron doped cutter can be controlled by adding boron metal, boron powder, or amorphous boron powder to pre-compact diamond mixture.

TABLE 1

Low melting temperature boron-containing and silicon-containing Ni alloys

| | AWS & AMS | Nominal Composition (wt. %) | | | | | | | | | Melting Temperature |
|---|---|---|---|---|---|---|---|---|---|---|---|
| Alloys | Classification | Cr | Fe | Si | C | B | Co | Pd | W | Ni | (° C.) |
| 1 | BNi-1/4775 | 14.5 | 4.5 | 4.5 | 0.8 | 3.3 | | | | Bal | 1038 |
| 2 | BNi-1a/4776 | 14 | 4.5 | 4.5 | | 3 | | | | Bal | 1077 |
| 3 | BNi-2/4777 | 7 | 3 | 4.2 | | 3 | | | | Bal | 999 |
| 4 | BNi-3/4778 | | | 4.5 | | 3 | | | | Bal | 1038 |
| 5 | BNi-4/4779 | | | 3.5 | | 1.8 | | | | Bal | 1066 |
| 6 | BNi-5/4782 | 19 | | 10 | | | | | | Bal | 1135 |
| 7 | BNi-5a | 19 | | 7.3 | 0.08 | 1.5 | | | | Bal | 1170 |
| 8 | BNi-5b | 15 | | 7.3 | 0.06 | 1.4 | | | | Bal | 1195 |
| 9 | BCo-1 | 19 | | 8 | | 0.8 | Bal. | | 4 | 17 | 1149 |
| 10 | | 15 | | | | 3.5 | | | | Bal | 1050 |
| 11 | | | | 3.5 | | 2.8 | 22 | | | Bal | 1129 |
| 12 | | 15 | | | 0.06 | 4 | | | | Bal | 1120 |
| 13 | | | | 6.1 | | | | 46.7 | | Bal | 851 |
| 14 | | | | 5 | | | | 45.5 | | Bal | 895 |
| 15 | | 10.5 | | 0.5 | | 3 | | 36 | | Bal | 960 |

In one aspect, the boron-containing alloy in HP/HT process may suppress sp2 carbon formation and improves crystallinity of the PDC, possibly leading to better wear and impact resistances.

In another aspect, the boron-containing alloy may enable in-situ boron doped HP/HT process to effectively consolidate PDC mass with diamond crystals less than 10 μm.

In still another aspect, the in-situ boron doped PDC has relatively lower residual compressive stress compared to undoped PDC that was manufactured under the same HP/HT process parameters.

In another aspect, in-situ boron doped PDC may be manufactured at temperature lower than that of the conventional PDC by 250° C. to 500° C.

In another aspect, in-situ boron doped PDC may exhibit higher thermal stability compared to the conventional PDC by greater than 150° C.

In yet another aspect, the as-pressed surface roughness of in-situ boron doped PDC is much smoother than that of the conventional PDC.

Description of the HP/HT Process

A typical PDC cutter is produced by high pressure and high temperature process. A layer of powder mixture of diamond and its catalyst metal powder at the bottom of niobium cup or other transition metal cup is pressed adjacent to the face of cylindrical shape of cemented carbide, WC bonded with cobalt. A second cup is reversed to form a capsule with the first cup to enclose the cemented carbide body and diamond powder mixtures. The subassembly is pressed through a die to tighten the contents becoming an enclosed can. In some case, e-beam welding is applied to joint the seams between two cups. Herein, typical cemented carbide contains tungsten carbide particles in the range of 1 to 25 μm and cobalt content in 6 to 20 percent by weight. Diamond particle size is from 5 to 50 μm, depending mechanical properties desired in PDC cutter application.

A closed can was further assembled within a pressure cell comprised of pressure transmitted materials such as pyrophillite, catlinite and talc and heating materials such as graphite. The pressure cell is heated to a diamond stable temperature in a high-pressure and high-temperature apparatus. Typical pressure and temperature are greater than 5 Gpa and 1350° C., respectively, and the duration is longer than 10 minutes. During such high-pressure and high-temperature process the individual diamond crystals are bonded together to form a polycrystalline skeleton mass with metals discontinuously dispersed at grain boundaries between diamond crystals. The metal phase is formed from the catalyst powders mixed with diamond crystals or cobalt metal which infiltrates from the cemented tungsten carbide body at a temperature sufficiently to cause Co to melt at a eutectic temperature. Although Co melting temperature is 1495° C., in HP/HT process Co melting temperature can be 1235 to 1340° C., depending on materials of additives and cup. The infiltration is limited and inapplicable to 10 μm or less of diamond crystals. Such high-pressure/high-temperature process to form PDC cutter or tools is well known and described in the prior art.

In the Preferred Embodiment, in-situ boron doped PDC used a boron-containing Ni alloy as a binder phase for polycrystalline diamond compact (PDC) in HP/HT process promotes, by liquid phase diffusion, in-situ boron doping on polycrystalline diamond or increase boron solubility in boron-doped diamond compact. The concentration of boron in diamond can be controlled by boron content in boron-containing Ni-alloy; fine boron powder (<20 μm), preferably sub-micron, can also be added to the diamond/boron-containing Ni-alloy powder mixture if high level of boron is desired in boron-doped PDC.

While low-melting-temperature Ni-alloy is used as a binder material, boron powder can be added into the original powder mixtures with diamond crystals and Ni-alloy to commence the in-situ boron doping process. At 1200° C., the solubility of B in Ni is about 18 wt. % at atmospheric pressure, even though the melting temperature of boron is 2300° C. During HP/HT process, B concentration decreases as doping reaction occurs and fine B particle will be dissolved into Ni—B—Si liquid. The maximum B content added to the mixture of diamond and boron-containing powder has not been determined yet. In the case of using boron-doped diamond, the boron-containing Ni-alloy would increase boron content in the original doped diamond crystals.

Figure 4:
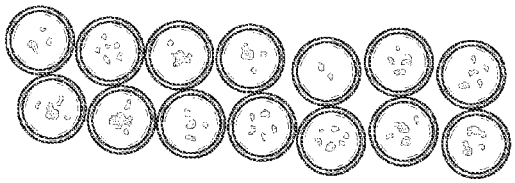
FIG. 4 shows a HP/HT pressed PDC cutter made with a conventional infiltration process.

The relatively extremely low melting temperature characteristics of boron-containing Ni alloy promotes infiltration and consolidation the PDC diamond compact which cannot be infiltrated by the convention process on fine grains of diamonds with a catalyst of Co. FIG. 4 shows surface defects such as crater and edge chipping in PDC layer on cemented carbide substrate, which was infiltrated at 1450° C. and at >6 Gpa. Prior to infiltration, diamond particles of 8-10 μm were spread at the bottom of transition metal cup and then pressed a cylinder of cemented carbide substrate into it.

Figure 5:
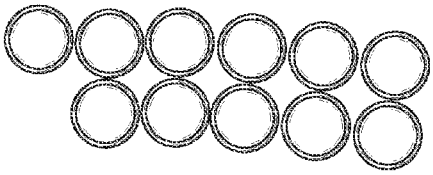
FIG. 5 shows a HP/HT pressed PDC cutter made with an in-situ boron-doped process via liquid boron diffusion.

In FIG. 5, a 0.04 mm thick disk of amorphous boron-containing alloy, Ni-7Cr-4.2Si-3B-3Fe, was Inserted between diamond particles and a cemented carbide cylinder and resulted in the flawless surface after HP/HT process. During the press operation, Ni-7Cr-4.2Si-3B-3Fe melted at about 1000° C.; the melted liquid infiltrated the small spaces between diamond crystals and boron diffusion reaction with diamond crystals occurred.

Further valuation on amorphous boron-containing alloy of Ni-7Cr-4.2Si-3B-3Fe was carried out on a mixture of 8-10 μm and 22-36 μm diamond crystals with 1:1 ratio. The un-doped and boron-doped PDC cutters were produced from the same diamond crystals and cemented carbide assembly with and without a boron-containing alloy disk, respectively.

Figure 6:
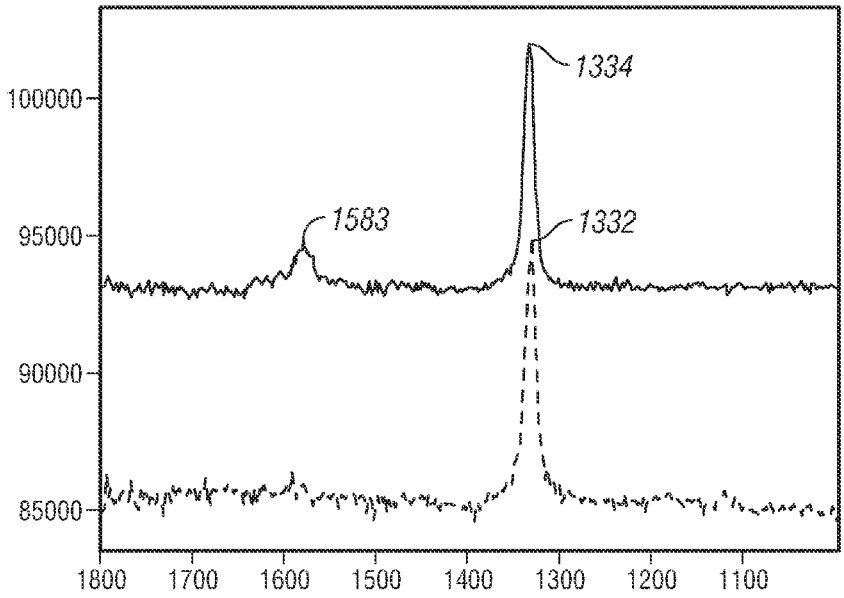
FIG. 6 is a graph of the Raman spectra of a standard PDC cutter overlaid with the Raman spectra of an in-situ boron-doped cutter.

FIG. 6 shows Raman spectra using laser wavelength of 514.5 nm excitation on the surfaces of these two 1308 PDC cutters. The un-doped cutter contained a catalyst of Co; and the latter comprised of Co, Ni, Si, and B. The spectrum of un-doped cutter exhibits a peak at 1583 cm−1, indicating sp2 carbon, G-band of amorphous carbon; with an addition of Ni-7Cr-4.2Si-3B-3Fe disk, the sp3 carbon crystalline diamond peak shifted from 1334.1 $cm^{-1}$ to 1331.7 $cm^{-1}$ and graphite peak was vanished.

Evidently, sp2 carbon was suppressed. It is postulated that Ni-7Cr-4.2Si-3B-3Fe became liquid at about 1000° C. and infiltrated through the spaces between diamond crystals; the onset temperature of the catalysis and boronizing reactions with diamond crystals was reduced; therefore, the diamond-to-diamond bonding reaction and the conversion of non-diamond carbon into diamond at diamond stable temperature/pressure region were better readied than that of the conventional un-doped PDC press cycle.

Although the advantage of using a low-melting-temperature catalyst was disclosed in U.S. Pat. No. 2,947,609 which provided nucleation and growth of diamond from a carbonaceous material at lower operative temperature and pressure, the lowest melting temperature of Ni alloys of Ni—Cr, Ni—Mn, Fe—Mn, Fe—Ni and Ni—Cu reported in this teaching was limited to 1200° C. The benefit of low melting temperature of boron-containing alloys less than 1200° C. in in-situ boron doped HP/HT process is apparent. It is also postulated that the use of low melting boron-containing Ni-alloy lowers catalyzed temperature of growing diamond from non-diamond carbon which is possibly formed during initial heating through graphite stable region. Conceivably, Cr and Si in the boron-containing Ni-alloy react with non-diamond carbon to form carbides in the liquid state.

Another advantage of using low-melting temperature Ni-alloy as listed in table 1 (above), cobalt-free polycrystalline diamond compact (PDC) can be manufactured. In a cutting or drilling operation, the conventional PDC is vulnerable to thermal degradation when frictional heating up to 900° C. aroused in PDC element. The heating causes localized crack and lead to catastrophic failure due to either cobalt volume change from hexagonal to face-centered-cubic phase transformation at 417° C., the differential expansion coefficient between diamond crystals and solvent metal catalyst, or graphitization of diamond by dissolving C into cobalt solvent catalyst in the graphite stable region. With a cobalt-free PDC, the catastrophic failure could likely be avoided.

Residual stress in the PDC layer can be calculated by Raman spectra shifts as described in the following formula:

$$\sigma(\text{Gpa})=(\Delta v/2.9)$$

Where, Δv is the Raman diamond peak shift of in-situ boron doped PDC with respect to the peak of natural diamond (1332.1 $cm^{-1}$). The undoped PDC cutter exhibited 690 Mpa (100 ksi) in compression; while in-situ boron-doped PDC cutter showed significantly stress reduction to 138 Mpa (20 ksi) in tension, which is nearly neutral if taking an experimental error into consideration. Effect of boron doping on reduction in residual compressive stress was also observed on 1613 PDC cutters.

FIG. 6 shows the Raman spectra of boron-doped powder and its HT/HP boron-doped PDC cutter with 514 nm Ar ion laser excitation. Due to boron presence in the lattice, the sp3 diamond shift to 1330 $cm^{-1}$; after HT/HP process, the consolidated boron-doped diamond shifted to 1333 $cm^{-1}$ due probably to residual compressive stress. In the boron-doped PDC cutter a small amount of sp2 carbon was detected. Similar phenomenon was observed in the HP/HT undoped PDC cutter.

In catalyst of Ni-3B-4.5Si, the Si and B seem to have positive role to suppress sp2 carbon formation; therefore, thermally stabilize diamond and more perfect crystallinity. In addition, the diffusion of B into surface of diamond crystals enhanced its toughness and high temperature capability (thermal resistance) of cutting. Due to its low melting temperature and the increase of the rate of surface rearrangement, the surface of the as-pressed doped cutter was much smoother than that of un-doped one.

EXAMPLE 1

A mass of diamond particles and boron-containing alloy powder Ni-4.5Si-3B were placed in a Nb cup, [B]=$2.9\times10^{19}$. A Co-cemented tungsten carbide substrate was inserted into the cup and on top of the powder mass and then assembled in a hollow pyrophyllite cube. The pyrophyllite assembly was placed in the reaction zone of a conventional high-pressure/high-temperature apparatus and subjected to 1450° C. and >6 Gpa for more than 16 minutes.

Recovered from the reaction zone was an in-situ boron-doped PDC, which comprised a mass of substantial amount of diamond-diamond bonding to a coherent skeletal doped-diamond mass with a binder phase of Co—Ni—Si with a trace Nb dispersed uniformly between diamond mass crystals. Co in the binder phase was infiltrated through Co-cement tungsten carbide substrate into diamond mass to alloy with boron-containing alloy present in the compact.

The doped cutting element was subjected to the conventional granite log wear test and its wear resistance compared favorably to the un-doped cutters.

EXAMPLE 2

A mass of diamond particles of 8-10 μm and catalyst powders were placed in a Nb cup.

A disk of Ni-7Cr-4.2Si-3B-3Fe in 0.04 mm thickness was placed on top of the powder mass before inserting a Co-cemented tungsten carbide substrate and then assembled in a hollow pyrophyllite cube. The pyrophyllite assembly was placed in the reaction zone of a conventional high-pressure/high-temperature apparatus and subjected to 1450° C. and >6 Gpa for more than 16 minutes. Boron content in PDC was estimated to be $1.2\times10^{20}$ atoms/$cm^3$.

Recovered from the reaction zone was an in-situ boron doped PDC cutter. After the Nb can was removed by grit blasting, the exposed surface of in-situ boron doped boron-doped PDC was defect-free and much smoother than that of conventional PDC synthesized with Co.

EXAMPLE 3

A mass of diamond particles of 10-20 μm, 5 wt % catalyst powders Ni-4.5Si-3B and 0.2-0.5 wt % B powder were placed in a Nb cup; and then a Co-cemented tungsten carbide substrate was placed on top of the powder mass to assemble in a hollow pyrophyllite cube. The pyrophyllite assembly was placed in the reaction zone of a conventional high pressure/high temperature apparatus and subjected to 1450° C. and >6 Gpa for more than 16 minutes. Boron content in PDC was estimated to be $4.2\times10^{20}$ atoms/$cm^3$ and $1.0\times10^{21}$ atoms/$cm^3$.

Recovered from the reaction zone was an in-situ boron-doped PDC cutter. After Nb can was removed by grit blasting, the exposed surface of the in-situ boron-doped PDC was defect-free and much smoother than that of conventional PDC synthesized with Co.

EXAMPLE 4

A mass of diamond particles of 50% 8-12 μm+50% 22-36 μm and catalyst powders were placed in a Nb cup. A disk of Ni-7Cr-4.2Si-3B-3Fe in 0.04 mm thickness was placed on top of the powder mass before inserting a Co-cemented tungsten carbide substrate and then assembled in a hollow pyrophyllite cube. The pyrophyllite assembly was placed in the reaction zone of a conventional high-pressure/high-temperature apparatus and subjected to 1450° C. and >6 Gpa for more than 16 minutes. Boron content in PDC was estimated to be $1.2\times10^{20}$ atoms/$cm^3$.

Recovered from the reaction zone was an in-situ boron-doped PDC cutter. After Nb can was removed by grit blasting, the exposed surface of in-situ boron-doped PDC was defect-free and much smoother than that of conventional PDC synthesized with Co. The in-situ boron-doped PDC cutter was subjected to progressive drop test: 8 lb hammer with 2 inch height increase each drop. In-situ boron-doped PDC cutter exhibited higher impact resistance compared to the conventional PDC cutter, the catastrophic failure threshold 16.2 joule versus 14.6 joule.

EXAMPLE 5

A mass of diamond particles of 20-26 μm, 5 wt % catalyst Ni-4.5Si-3B powders were placed in a Nb cup and then a Co-cemented tungsten carbide substrate was placed on top of the powder mass to assemble in a hollow pyrophyllite cube. The pyrophyllite assembly was placed in the reaction zone of a conventional high-pressure/high-temperature apparatus and subjected to 1450° C. and >6 Gpa for more than 16 minutes. Boron content in PDC was estimated to be $2.9\times10^{19}$ atoms/$cm^3$.

Recovered from the reaction zone was an in-situ boron-doped PDC cutter. After Nb can was removed by grit blasting, the exposed surface of in-situ boron-doped PDC was defect-free. The cutters were brazed onto a bi-center bit and subjected to drilling test on VMS 140 casing with 70-80 RPM and 8,000-10,000 pounds weight on bit (WOB). Due to high thermal resistance, In-situ boron-doped PDC out-performed the conventional PDC cutter.

Whereas the present invention has been described in particular relation to the drawings attached hereto, it should be understood that other and further modifications apart from those shown or suggested herein, may be made within the scope and spirit of the present invention.

What is claimed is:

1. A polycrystalline diamond compact, comprising:

a layer of polycrystalline diamond integrally formed in a high-temperature, high-pressure in-situ boron-doped process, the layer comprising a generally uniform mixture of diamond crystals and boron-containing alloy formed of Ni—, Co— or Fe—, and boron powder, said boron-containing alloy having a melting temperature between about 960° C. and about 1200° C., said mixture being consolidated via liquid diffusion of boron into the diamond crystals at a pressure between about 5 Gpa and about 7 Gpa and at a temperature greater than 950° C. and less than 1450° C.

2. The polycrystalline diamond compact of claim 1, wherein the diamond crystals comprise a synthetic diamond and wherein the boron-containing alloy comprises Ni, Co and Fe-base alloys having a melting temperature less than about 1200° C.

3. The polycrystalline diamond compact of claim 2, wherein the boron-containing alloy comprises Ni, Co and Fe-base alloys having a minimum melting temperature of 1000° C.

4. The polycrystalline diamond compact of claim 3, wherein the boron-containing alloy and the Ni, Co and Fe-base alloys have a melting temperature below about 1100° C. and wherein the boron-containing alloy comprises the Ni, Co and Fe-base alloys.

5. The polycrystalline diamond compact of claim 4, wherein the melting temperature is greater than 1000° C. and less than 1200° C.

6. The polycrystalline diamond compact of claim 2, wherein the diamond crystals have a particle size between 8 μm and 10 μm.

7. The polycrystalline diamond compact of claim 1, wherein the diamond crystal comprises synthetic diamond and boron-doped diamond crystals manufactured by chemical vapor deposition and high-temperature, high-pressure processes, and natural diamonds comprising a source material.

8. The polycrystalline diamond compact of claim 7, wherein the boron-containing alloy comprises Ni, Co and Fe-base alloys having a melting temperature below about 1200° C.

9. The polycrystalline diamond compact of claim 8, wherein the melting temperature of the Ni, Co and Fe-base alloys is below about 1200° C.

10. The polycrystalline diamond compact of claim 1, wherein a source of the polycrystalline diamond comprises synthetic diamond and wherein the boron-containing alloy comprises Ni, Co and Fe-base alloys having a melting temperature of less than about 1200° C.

11. An earth boring drill bit, comprising:

a polycrystalline diamond cutting element with a layer of polycrystalline diamond integrally formed in a high-temperature, high-pressure in-situ boron-doped process, the layer comprising an in-situ boron-doped polycrystalline diamond compact comprising a generally uniform mixture of diamond crystals and boron-containing alloy formed of Ni—, Co— or Fe—, and boron powder, said boron-containing alloy having a melting temperature between about 960° C. and about 1200° C., said mixture being consolidated via liquid diffusion of boron into the diamond crystals at a pressure greater than 5 Gpa and less than 7 Gpa and at a temperature greater than 950° C. and less than 1450° C.

12. A method for making an in-situ boron-doped polycrystalline diamond compact, comprising:

forming a layer of polycrystalline diamond integrally in a high-temperature, high-pressure in-situ boron-doped process comprising in-situ boron-doped polycrystalline diamond compact by consolidating a generally uniform mixture of diamond crystals and boron-containing alloy formed of Ni—, Co— or Fe—, and boron powder, said boron-containing alloy having a melting temperature between about 960° C. and about 1200° C., said mixture formed via liquid diffusion of boron into diamond crystals at a pressure greater than 5 Gpa and less than 7 Gpa and at a temperature greater than 950° C. and less than 1195° C.

13. The method of claim 12 wherein synthetic diamond and boron-doped diamond crystals manufactured by chemical vapor deposition and high-temperature, high-pressure processes, and natural diamonds are used as a source material.

14. The method of claim 13 wherein the boron-containing alloy comprises Ni-, Co-, and Fe-base alloys, or mixtures thereof, having melting temperatures below 1200° C. and wherein the method further comprises converting diamond from graphite having a pressure of greater than 5.5 Gpa.

15. The method of claim 14, wherein the melting temperature of the boron-containing alloy is between about 960° C. to 1200° C.

16. The method of claim 15, wherein the boron-containing alloy suppresses sp2 carbon formation, thereby improving crystallinity of the in-situ boron-doped polycrystalline diamond compact.

17. The method of claim 15, wherein the boron-containing alloy is enabled by the in-situ boron doped high-temperature, high-pressure to effectively consolidate a polycrystalline diamond mass with diamond crystals sizes less than 10 μm.

18. A polycrystalline diamond cutting element, comprising:

a preform cutting element in a fixed cutter rotary drill bit, the preform cutting element having a body in a form of a circular tablet with a front facing table of polycrystalline diamond that is integrally formed with a substrate of less hard material and bonded on a generally cylindrical carrier, the preformed cutting element formed in a high-temperature, high-pressure in-situ boron-doped process, the tablet comprising an in-situ boron-doped formed polycrystalline diamond compact comprising a generally uniform mixture of diamond crystals and boron-containing alloy formed of Ni—, Co— or Fe—, and boron powder, said boron-containing alloy having a melting temperature between about 960° C. and about 1200° C., said mixture consolidated via liquid diffusion of boron into diamond crystals at a pressure between about 5 Gpa and about 7 Gpa and at a temperature greater than 950° C. and less than 1450° C.

19. The polycrystalline diamond cutting element of claim 18, wherein the preform cutting element has relatively lower residual compressive stress compared to un-doped preform cutting element that was manufactured under the same high-temperature, high-pressure process parameters.

20. The polycrystalline diamond cutting element of claim 18, wherein the cutting element is located on the body of the fixed cutter rotary drill bit adapted for casing milling and formation drilling such that it is a primarily cutting element for drilling through steel casing.

21. The polycrystalline diamond cutting element of claim 18, wherein the in-situ boron doped polycrystalline diamond cutting element is fixed upon a body of the fixed cutter rotary drill bit adapted for geothermal drilling.

* * * * *